US011451917B2

(12) United States Patent
Petroff

(10) Patent No.: US 11,451,917 B2
(45) Date of Patent: Sep. 20, 2022

(54) ACOUSTIC SYSTEM WITH SPATIAL EFFECT

(71) Applicant: DEVIALET, Paris (FR)

(72) Inventor: Antoine Petroff, Paris (FR)

(73) Assignee: DEVIALET, Paris (FR)

( * ) Notice: Subject to any disclaimer, the term of this patent is extended or adjusted under 35 U.S.C. 154(b) by 0 days.

(21) Appl. No.: 17/283,349

(22) PCT Filed: Oct. 9, 2019

(86) PCT No.: PCT/EP2019/077296
§ 371 (c)(1),
(2) Date: Apr. 7, 2021

(87) PCT Pub. No.: WO2020/074553
PCT Pub. Date: Apr. 16, 2020

(65) Prior Publication Data

US 2022/0007125 A1 Jan. 6, 2022

(30) Foreign Application Priority Data

Oct. 9, 2018 (FR) ..... 18 59338

(51) Int. Cl.
*H04S 3/00* (2006.01)
*H04R 1/40* (2006.01)

(52) U.S. Cl.
CPC ..... *H04S 3/00* (2013.01); *H04R 1/403* (2013.01); *H04R 2201/401* (2013.01); *H04S 2400/01* (2013.01); *H04S 2400/07* (2013.01)

(58) Field of Classification Search
CPC combination set(s) only.
See application file for complete search history.

(56) References Cited

U.S. PATENT DOCUMENTS 8,774,424 B2 7/2014 Fletcher
9,197,963 B1 11/2015 North
(Continued)

FOREIGN PATENT DOCUMENTS

CN 102273221 12/2011
CN WO-2018157417 A1 * 9/2018 ..... H03G 3/32
WO WO 2018/227607 12/2018

OTHER PUBLICATIONS

International Search Report for PCT/EP2019/077296 dated Dec. 2, 2019.
Preliminary Search Report for FR 1859338 dated Apr. 10, 2019.

*Primary Examiner* — Duc Nguyen
*Assistant Examiner* — Assad Mohammed
(74) *Attorney, Agent, or Firm* — B. Aaron Schulman, Esq.; Stites & Harbison, PLLC

(57) ABSTRACT

An acoustic system (1) for diffusing sound from N channels (Si) comprising audio frequencies, N being greater than or equal to two, the acoustic system comprising a frame (5), M loudspeakers (HPj) which are similar to each other and mounted on the frame (5), and a processing unit (20) designed to send M loudspeaker signals (SSj) to the loudspeakers respectively.
The loudspeakers are arranged at an angle about an axis (Z), two successive loudspeakers forming an angle (a) substantially equal to 360° divided by M.
The processing unit (20) comprises a splitter (28) configured to produce the loudspeaker signals (SSj), each loudspeaker signal comprising the same shared bass component ($SS_{LF}$) in which audio frequencies that are higher than a first predetermined frequency (f1) are non-existent or reduced, at least two of the loudspeaker signals further comprising a specific component ($SS_{j,MF}$) in addition to the shared bass component and in which the audio frequencies below the first frequency are non-existent or reduced, each specific com-
(Continued)

Figure 1:
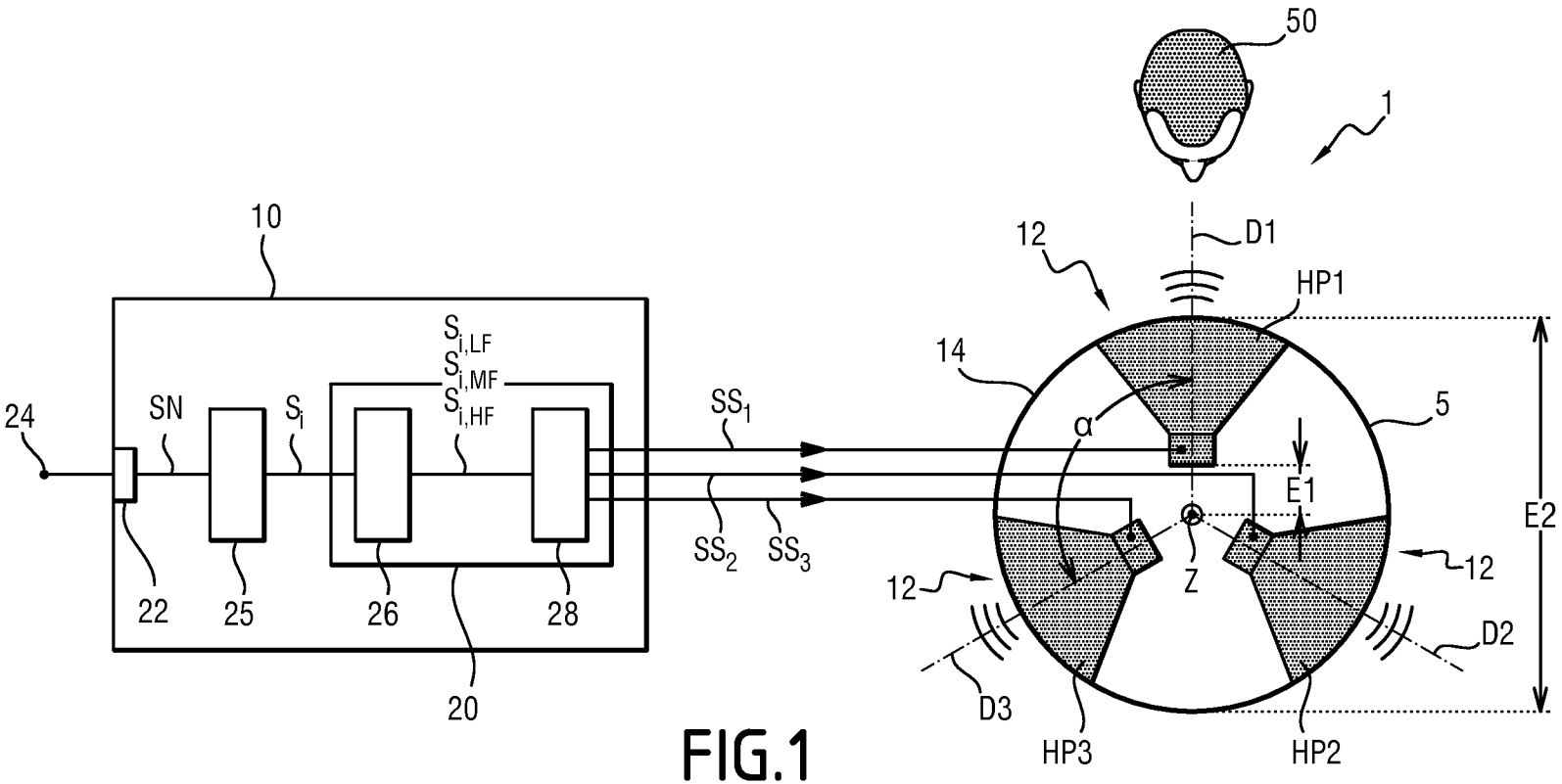

ponent being obtained from at least one of the channels, and at least two of the specific components being different from each other.

11 Claims, 5 Drawing Sheets

(56) References Cited

U.S. PATENT DOCUMENTS

| | | | | |
|---|---|---|---|---|
| 9,942,686 | B1 | 4/2018 | Family et al. | |
| 10,405,125 | B2 | 9/2019 | Family et al. | |
| 2011/0249857 | A1* | 10/2011 | Fletcher | H04R 1/403<br>381/386 |
| 2012/0013768 | A1* | 1/2012 | Zurek | H04R 3/005<br>348/E5.031 |
| 2017/0289723 | A1 | 10/2017 | Yoo et al. | |
| 2018/0098171 | A1 | 4/2018 | Family et al. | |
| 2018/0098172 | A1* | 4/2018 | Family | H04R 1/403 |
| 2019/0020950 | A1* | 1/2019 | Bongiovi | H03G 9/005 |

* cited by examiner

ACOUSTIC SYSTEM WITH SPATIAL EFFECT

BACKGROUND OF THE INVENTION

Field of the Invention

The present invention relates to an acoustic system designed for diffusing sound from N channels (Si) comprising audio frequencies, N being greater than or equal to two, the acoustic system comprising:

a frame,

M loudspeakers ($HP_j$) that are structurally similar to each other and mounted on the frame, M being greater than or equal to two, and a processing unit designed to send M loudspeaker signals ($SS_j$) to the respective loudspeakers (HPj).

The invention also relates to a corresponding method.

Description of Related Art

Known acoustic systems are designed for diffusing sound in stereophony, more commonly called stereo, from two channels, left and right, respectively diffused by two loudspeakers generally directed substantially parallel to each other toward a listener. Such a technique aims at reconstituting a spatial distribution of sound sources, as if the listener was, for example, in front of an orchestra.

It is also known to diffuse sound from a larger number of channels and an equal number of loudspeakers, more or less isolated and distributed around a listener. The 5.1 multichannel ("5.1 surround sound") format has six sound channels:

a left channel (abbreviated as "L" for left) intended to be diffused by a loudspeaker located in front of the listener, on the left, a right channel (abbreviated "R" for right) intended to be diffused by a loudspeaker located in front of the listener, on the right, a center channel ("C" for center) diffused by a loudspeaker normally located between the left and right loudspeakers a left surround channel ("SL" for surround left), usually diffused from a loudspeaker located on the left behind the listener a surround right channel ("SR" for surround right) diffused from a loudspeaker behind the listener on the right, and a low frequency effect ("LSE") channel diffused by a loudspeaker known as a subwoofer and designed to diffuse the lower frequencies of the audio spectrum.

Two-speaker stereo systems are satisfactory and appreciated for their simplicity. However, they sometimes lack depth. Indeed, the listener is able to isolate the origin of sounds in a left-right direction, but not or little in a perpendicular and appreciably horizontal direction, materializing the depth. Thus, this system cannot distinguish sounds coming from the back or the front of an orchestra, for example.

Systems with a larger number of channels, such as the aforementioned 5.1, can achieve a depth effect, but require the placement and connection of a large number of loudspeakers spread around the listener.

An object of the invention is therefore to provide an acoustic system as described above, and giving the impression of depth of sound to the listener, while remaining simple and easy to implement.

BRIEF SUMMARY OF THE INVENTION

To this end, the invention relates to an acoustic system as described above, in which:

the loudspeakers ($HP_j$) are arranged at an angle about an axis (Z) intended to be substantially vertical, two successive loudspeakers ($HP_j$) forming an angle substantially equal to 360° divided by M, and the processing unit comprises a splitter configured to produce the loudspeaker signals ($SS_j$), each loudspeaker signal ($SS_j$) comprising a shared bass component ($SS_{LF}$) obtained from at least one of the channels ($S_i$), and in which audio frequencies that are higher than a predetermined first frequency (f1) are non-existent or reduced at least two of the loudspeaker signals (SSj) further comprising a specific component ($SS_{j,MF}$) in addition to the shared bass component ($SS_{LF}$) and in which the audio frequencies below the first frequency (f1) are non-existent or reduced, each specific component ($SS_{j,MF}$) being obtained from at least one of the channels ($S_i$), and at least two of the specific components ($SS_{j,MF}$) being different from each other.

According to particular embodiments, the acoustic system comprises one or more of the following features, taken in any technically possible combination:

the first frequency (f1) is greater than or equal to 200 Hz and less than or equal to 500 Hz;

the acoustic system comprises a frequency selector designed to produce, from each channel ($S_i$), on the one hand a low frequency signal ($S_{i,LF}$) in which the audio frequencies of the channel ($S_i$) higher than the first frequency (f1) are non-existent or reduced, and, on the other hand, if said channel ($S_i$) comprises audio frequencies that are higher than the first frequency (f1), at least one other signal ($S_{i,MF}$) in which the audio frequencies of the channel ($S_i$) lower than the first frequency (f1) are non-existent or reduced the shared bass component ($SS_{LF}$) being proportional to the sum of the low frequency signals ($S_{i,LF}$);

the specific components ($SS_{j,MF}$) being obtained from the other signals ($S_{i,MF}$);

the specific components ($SS_{j,MF}$) are linear combinations of at least some of the other signals ($S_{i,MF}$);

the frequency selector is further configured to extract, from each respective channel ($S_i$) comprising audio frequencies that are higher than a predetermined second frequency (f2), a high frequency signal ($S_{i,HF}$) in which the audio frequencies of said channel ($S_i$) below the second frequency (f2) are non-existent or reduced, the second frequency (f2) being higher than the first frequency (f1), the frequency selector being configured so that, in each of the other signals ($S_{i,MF}$), the audio frequencies that are higher than the second frequency (f2) are non-existent or reduced; and at least one, preferably all, of the loudspeaker signals ($SS_j$) formed by the splitter further comprises a shared high frequency component ($SS_{HF}$) proportional to the sum of the high frequency signals ($S_{i,HF}$), the shared high frequency component ($SS_{HF}$) being in addition to the shared bass component ($SS_{LF}$);

the second frequency (f2) is greater than or equal to 1000 Hz and less than or equal to 10000 Hz;

the acoustic system is designed for diffusing the sound from a stereo source, the channels ($S_i$) comprising a left channel L and a right channel R; the number M of loudspeakers ($HP_j$) is equal to two, the loudspeakers ($HP_j$)

comprising a first loudspeaker $HP_1$ receiving a first loudspeaker signal $SS_1$; and a second loudspeaker $HP_2$ receiving a second loudspeaker signal $SS_2$; and the splitter is configured so that:

$$SS_1=a*[1*L_{MF}+SS_{LF}+SS_{HF}] \text{ and}$$

$$SS_2=a*[1*R_{MF}+SS_{LF}+SS_{HF}],$$

$$\text{with } SS_{LF}=½*(L_{LF}+R_{LF}) \text{ and } SS_{HF}=½*(L_{HF}+R_{HF}),$$

$L_{LF}$ being the low frequency signal of the left channel L, $L_{MF}$ being the other signal of the left channel L, $L_{HF}$ being the high frequency signal of the left channel L, $R_{LF}$ being the low frequency signal of the right channel R, $R_{MF}$ being the other signal of the right channel R, $R_{HF}$ being the high frequency signal of the right channel R, a being a proportionality coefficient;

the acoustic system is designed for diffusing the sound from a stereo source, the channels ($S_i$) comprising a left channel L and a right channel R; the number M of loudspeakers ($HP_j$) is equal to three, the loudspeakers ($HP_j$) comprising a first loudspeaker $HP_1$ receiving a first loudspeaker signal $SS_i$, a second loudspeaker $HP_2$ receiving a second loudspeaker signal $SS_2$, and a third loudspeaker $HP_3$ receiving a third loudspeaker signal $SS_3$; and the splitter (28) is configured so that:

$$SS_1=a*[½*(L_{MF}+R_{MF})+SS_{LF}+SS_{HF}],$$

$$SS_2=a*[½*L_{MF}+SS_{LF}+SS_{HF}], \text{ and}$$

$$SS_3=a*[½*R_{MF}+SS_{LF}+SS_{HF}],$$

$$\text{with } SS_{LF}=⅓*(L_{LF}+R_{LF}) \text{ and } SS_{HF}=⅓*(L_{HF}+R_{HF}),$$

$L_{LF}$ being the low frequency signal of the left channel L, $L_{MF}$ being the other signal of the left channel L, $L_{HF}$ being the high frequency signal of the left channel L, $R_{LF}$ being the low frequency signal of the right channel R, $R_{MF}$ being the other signal of the right channel R, $R_{HF}$ being the high frequency signal of the right channel R, a being a proportionality coefficient;

the acoustic system is designed for diffusing the sound from a five-channel source $S_1$ to $S_5$ and one channel $S_6$ without audio frequencies that are higher than the first frequency (f1); the number M of loudspeakers ($HP_j$) is equal to three, the loudspeakers ($HP_j$) comprising a first loudspeaker $HP_1$ receiving a first loudspeaker signal $SS_1$, a second loudspeaker $HP_2$ receiving a second loudspeaker signal $SS_2$, and a third loudspeaker $HP_3$ receiving a third loudspeaker signal $SS_3$; and the splitter (28) is configured so that:

$$SS_1=a*[⅓*S_{1,MF}+⅓*S_{2,MF}+1*S_{3,MF}+SS_{LF}+SS_{HF}],$$

$$SS_2=a*[⅔*S_{1,MF}+1*S_{4,MF}+SS_{LF}+SS_{HF}], \text{ and}$$

$$SS_3=a*[⅔*S_{2,MF}+1*S_{5,MF}+SS_{LF}+SS_{HF}],$$

$$\text{with } SS_{LF}=⅓*(S_{1,LF}+S_{2,LF}+S_{3,LF}+S_{4,LF}+S_{5,LF}+S_{5,LF}+S_{6,LF}),$$

$$\text{and } SS_{HF}=⅓*(S_{1,HF}+S_{2,HF}+S_{3,HF}+S_{4,HF}+S_{5,HF}+S_{5,LF}),$$

$S_{1,LF}$ to $S_{6,LF}$ being the low frequency signals of channels $S_1$ to $S_6$, with $S_{6,LF}=S_6$, $S_{1,MF}$ to $S_{6,MF}$ being the other signals of channels $S_1$ to $S_6$, $S_{1,HF}$ to $S_{6,HF}$ being the high frequency signals of channels $S_1$ to $S_6$, a being a proportionality coefficient;

the acoustic system is designed for diffusing the sound from a stereo source, the channels ($S_i$) comprising a left channel L and a right channel R; the number M of loudspeakers ($HP_j$) is equal to four, the loudspeakers ($HP_j$) comprising a first loudspeaker $HP_1$ receiving a first loudspeaker signal $SS_1$, a second loudspeaker $HP_2$ receiving a second loudspeaker signal $SS_2$, a third loudspeaker $HP_3$ receiving a third loudspeaker signal $SS_3$, and a fourth loudspeaker $HP_4$ receiving a fourth loudspeaker signal $SS_4$; and the splitter device is configured so that:

$$SS_1=a*[½*L_{MF}+SS_{LF}+SS_{HF}],$$

$$SS_2=a*[½*R_{MF}+SS_{LF}+SS_{HF}],$$

$$SS_3=a*[½*L_{MF}+SS_{LF}+SS_{HF}], \text{ and}$$

$$SS_4=a*[½*R_{MF}+SS_{LF}+SS_{HF}],$$

$$\text{with } SS_{LF}=¼*(L_{LF}+R_{LF}) \text{ and } SS_{HF}=¼*(L_{HF}+R_{HF}),$$

$L_{LF}$ being the low frequency signal of the left channel L, $L_{MF}$ being the other signal of the left channel L, $L_{HF}$ being the high frequency signal of the left channel L, $R_{LF}$ being the low frequency signal of the right channel R, $R_{MF}$ being the other signal of the right channel R, $R_{HF}$ being the high frequency signal of the right channel R, a being a proportionality coefficient; and the acoustic system is designed for diffusing the sound from a five-channel source $S_1$ to $S_5$ and one channel $S_6$ having no audio frequencies that are higher than the first frequency (f1); the number M of loudspeakers ($HP_j$) is equal to four, the loudspeakers ($HP_j$) comprising a first loudspeaker $HP_1$ receiving a first loudspeaker signal $SS_1$, a second loudspeaker $HP_2$ receiving a second loudspeaker signal $SS_2$, a third loudspeaker $HP_3$ receiving a third loudspeaker signal $SS_3$, and a fourth loudspeaker $HP_4$ receiving a fourth loudspeaker signal $SS_4$; and the splitter is designed such that:

$$SS_1=a*[1*S_{3,MF}+¼*S_{1,MF}+¼*S_{2,MF}+SS_{LF}+SS_{HF}],$$

$$SS_2=a*[¾*S_{1,MF}+½*S_{4,MF}+SS_{LF}+SS_{HF}],$$

$$SS_3=a*[½*S_{4,MF}+½*S_{5,MF}+SS_{LF}+SS_{HF}], \text{ and}$$

$$SS_4=a*[¾*S_{2,MF}+½*S_{5,MF}+SS_{LF}+SS_{HF}],$$

$$\text{with } SS_{LF}=¼*(S_{1,LF}+S_{2,LF}+S_{3,LF}+S_{4,LF}+S_{5,LF}+S_{5,LF}+S_{6,LF}),$$

$$\text{and } SS_{HF}=¼*(S_{1,HF}+S_{2,HF}+S_{3,HF}+S_{4,HF}+S_{5,HF}+S_{5,LF}),$$

$S_{1,LF}$ to $S_{6,LF}$ being the low frequency signals of channels $S_1$ to $S_6$, with $S_{6,LF}=S_6$, $S_{1,MF}$ to $S_{6,MF}$ being the other signals of channels $S_1$ to $S_6$, $S_{1,HF}$ to $S_{6,HF}$ being the high frequency signals of channels $S_1$ to $S_6$, a being a proportionality coefficient.

The invention also relates to a method for diffusing the sound from N channels ($S_i$) comprising audio frequencies, N being greater than or equal to two, the method comprising the following steps:

providing M loudspeakers ($HP_j$), structurally similar to each other and mounted on a same frame, M being greater than or equal to two, the loudspeakers ($HP_j$) being arranged at an angle around an axis (Z) intended to be substantially vertical, two successive loudspeakers ($HP_j$) forming an angle substantially equal to 360° divided by M, sending, by a processing unit, M loudspeaker signals ($SS_j$) to the respective loudspeakers ($HP_j$), and production of the loudspeaker signals ($SS_j$) by a splitter (28) of the processing unit, each loudspeaker signal ($SS_j$) produced comprising the same shared bass component ($SS_{LF}$) obtained from at least one of the channels ($S_i$), and in which the audio frequencies that are higher than a predetermined first frequency (f1) are non-existent or reduced at least two of the loudspeaker signals ($SS_j$) further comprising a specific component ($SS_{j,MF}$) in addition to the shared bass component ($SS_{LF}$) and in which the audio frequencies below the first frequency (f1) are non-existent or reduced, each specific component ($SS_{j,MF}$) being obtained from at least one of the channels ($S_i$), and at least two of the specific components ($SS_{j,MF}$) being different from each other.

BRIEF DESCRIPTION OF THE SEVERAL VIEWS OF THE DRAWING(S)

Figure 2:
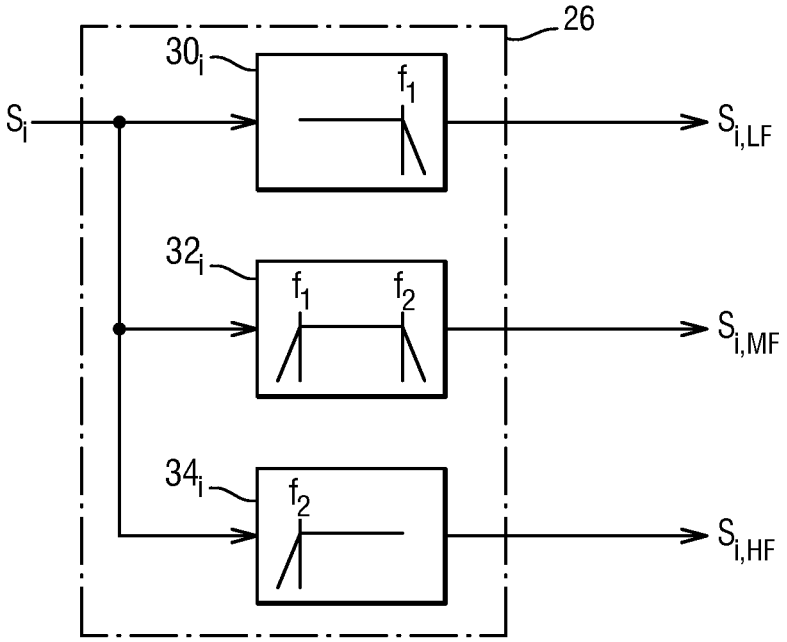

The invention will be better understood from the following description, given only by way of example and made with reference to the appended drawings, in which:

FIG. 1 is a generic schematic view of an acoustic system according to the invention, FIG. 2 is a schematic view of a frequency selector of the acoustic system shown in FIG. 1

Figure 3:
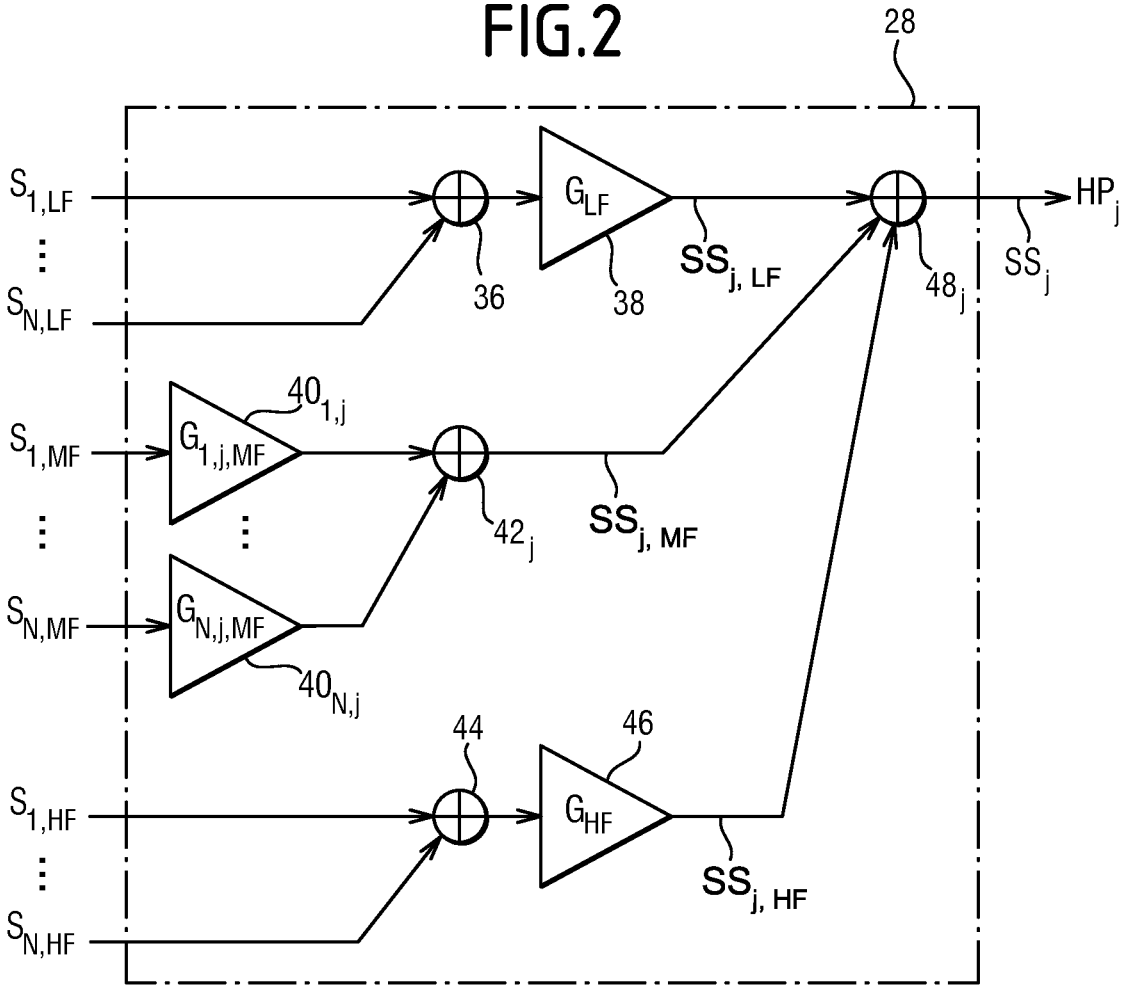
Figure 4:
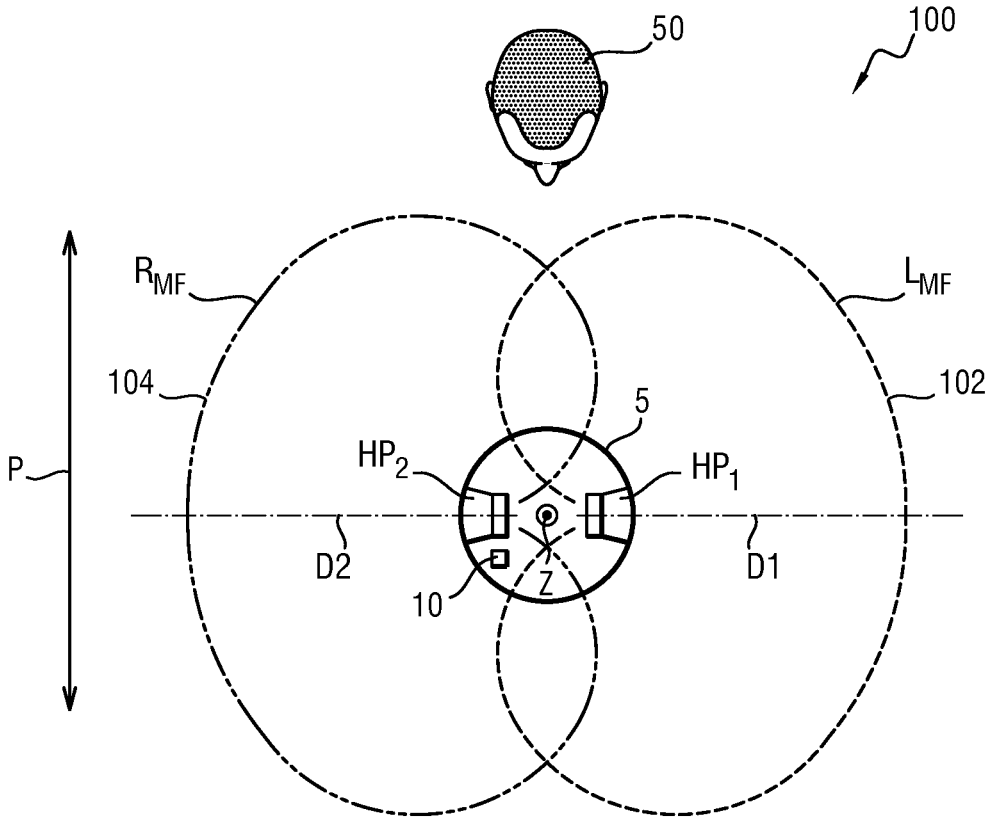
Figure 5:
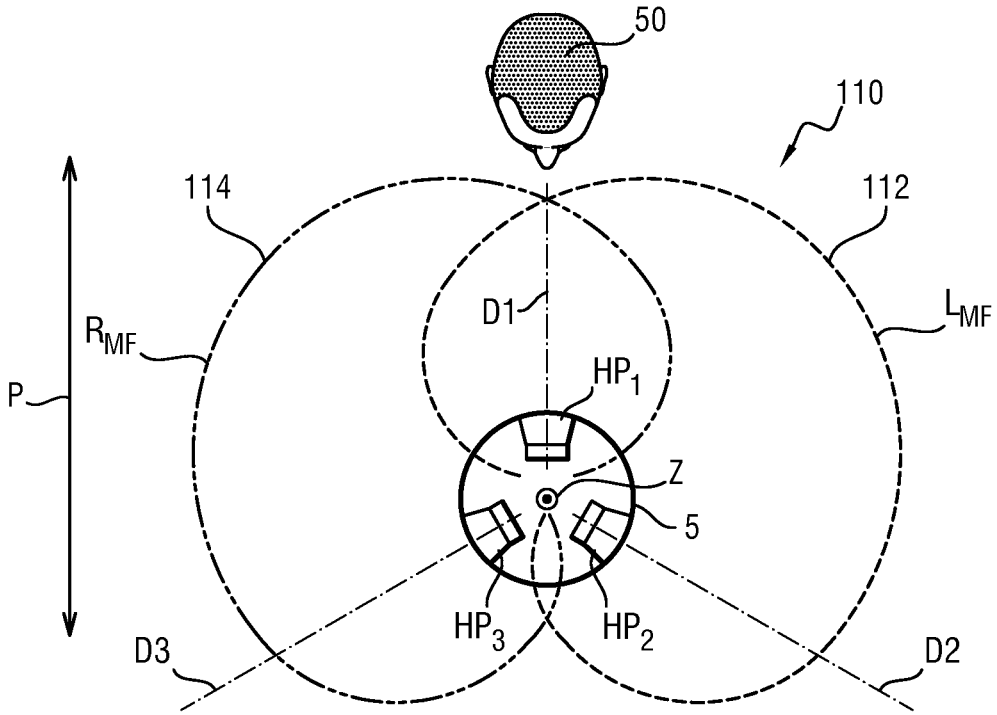
Figure 6:
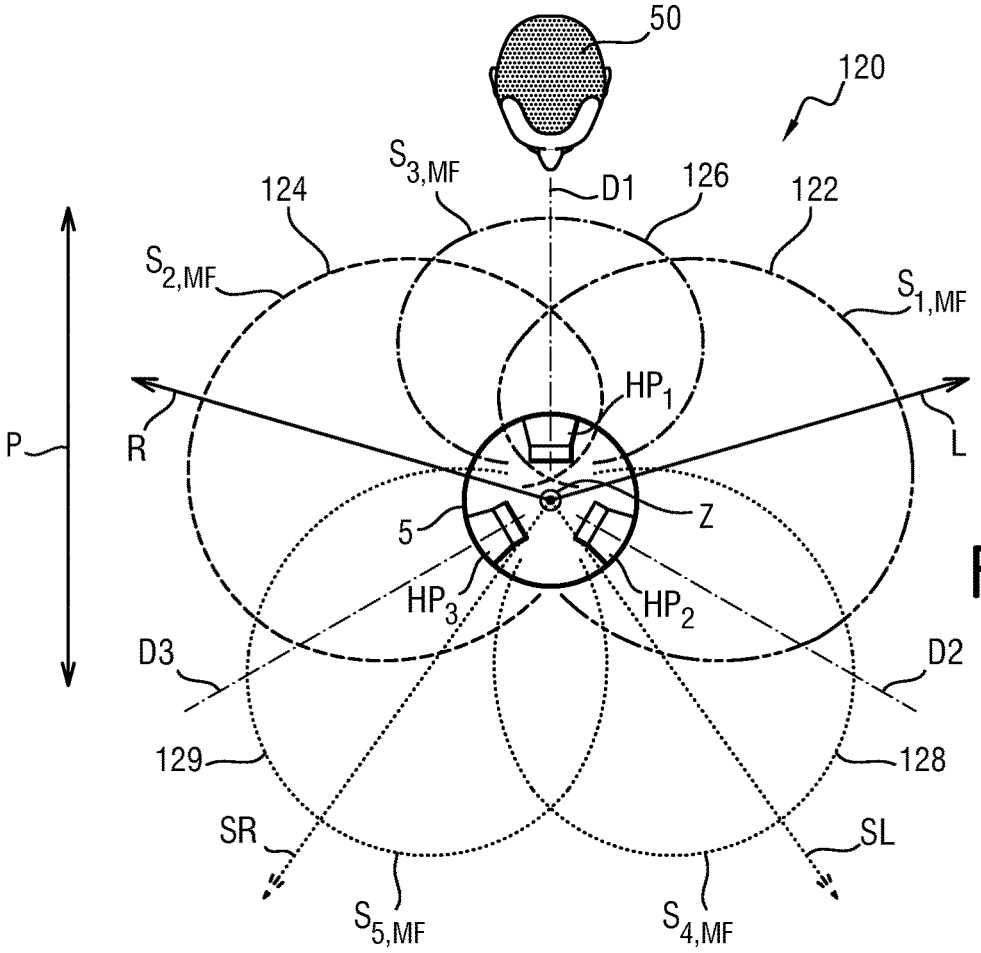
Figure 7:
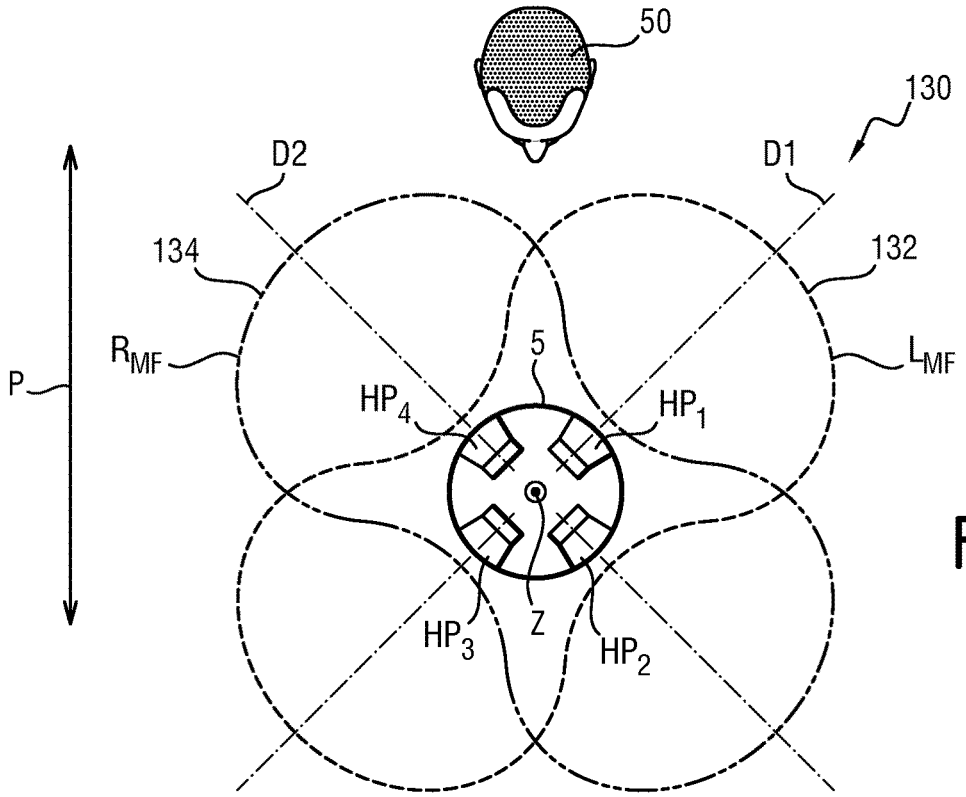
Figure 8:
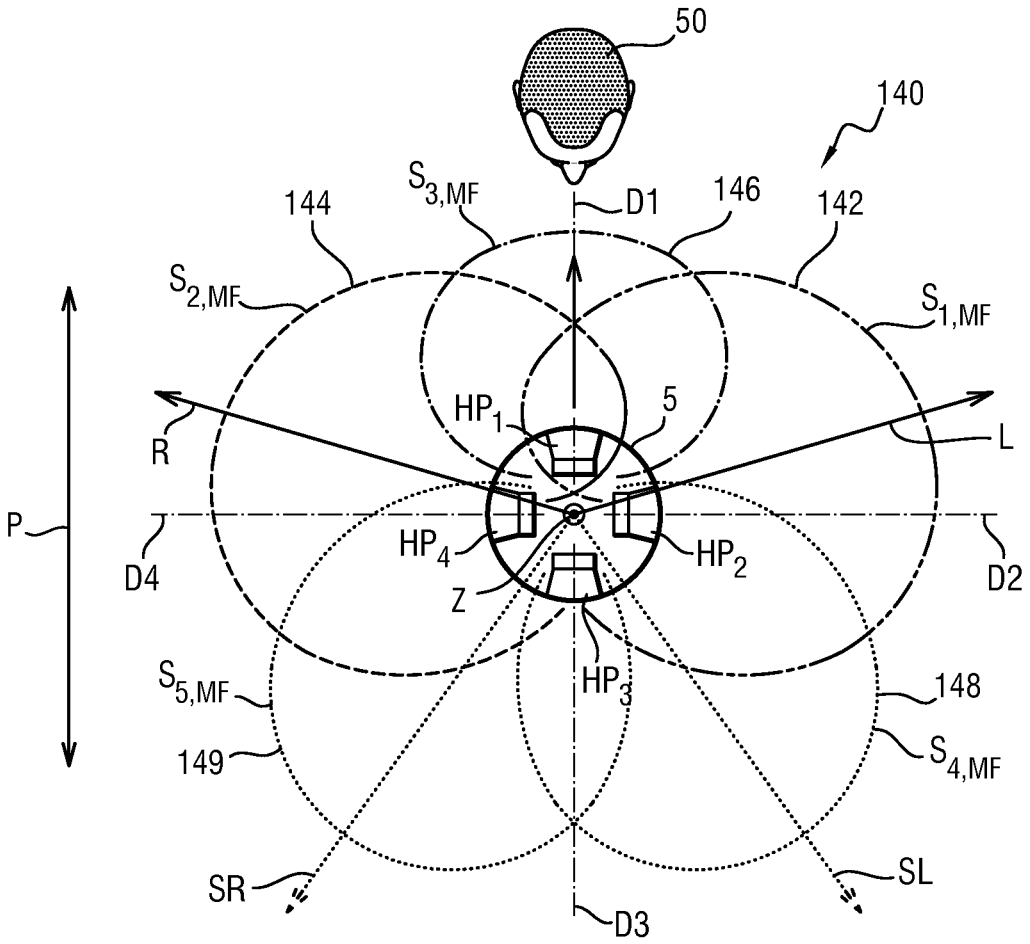

FIG. 3 is a schematic view of the splitter of the acoustic system shown in FIG. 1, FIG. 4 is a schematic top view illustrating an acoustic system according to a first embodiment of the invention with two channels and two loudspeakers, FIG. 5 is a schematic top view of an acoustic system according to a second embodiment of the invention with three loudspeakers and two channels, FIG. 6 is a schematic top view of an acoustic system according to a third embodiment of the invention with three loudspeakers and six channels, FIG. 7 is a schematic top view of an acoustic system according to a fourth embodiment of the invention with four loudspeakers and two channels, and FIG. 8 is a schematic top view of the acoustic system according to a fifth embodiment of the invention with four loudspeakers and six channels.

DETAILED DESCRIPTION OF THE INVENTION

With reference to FIGS. 1 to 3, an acoustic system 1 according to the invention is described. The acoustic system 1 is designed for diffusing the sound from sound channels $S_i$, i being an integer between 1 and N, N being the number of channels and being greater than or equal to 2. The acoustic system 1 comprises a frame 5, M loudspeakers $HP_j$ which are structurally similar to each other and mounted on the frame 5, and processing electronics 10 designed to send M loudspeaker the signals $SS_j$ to the respective loudspeakers $HP_j$, j being an integer between 1 and M.

In the invention, M is greater than or equal to two. In the example shown in FIG. 1, M is equal to 3.

According to particular embodiments shown in FIGS. 5 and 6, M is equal to 3.

According to particular embodiments shown in FIGS. 7 and 8, respectively, M is equal to 4.

In a variant (not shown), M is strictly greater than 4.

The frame 5 advantageously forms a box defining openings 12 in which the loudspeakers $HP_1$, $HP_2$, $HP_3$ are mounted. The frame 5 has for example a circular shape when viewed along a substantially vertical Z axis.

The loudspeakers $HP_j$ are mounted so as to diffuse sound centrifugally with respect to the Z axis. The loudspeakers $HP_j$ define the $D_j$ axes, that is, D1, D2, D3 in the example. The loudspeakers $HP_j$ are arranged so that the $D_j$ axes of two successive loudspeakers form an angle α substantially equal to 360° divided by M, that is, 120° in the example shown.

The loudspeakers $HP_j$ are structurally similar to each other.

For example, the loudspeakers $HP_j$ are located at the same distance E1 from the Z axis. Advantageously, the assembly formed by the loudspeakers $HP_j$ fits in a sphere 14 having a diameter E2 advantageously less than 1 m.

The processing electronics 10 includes a processing unit 20 designed to prepare the M loudspeaker signals $SS_j$ from the N channels $S_l$. In the example shown, the processing electronics 10 includes a connector 22 designed to be connected to a source 24 of digital signals SN, such as a cell phone, a personal computer or an internet source, and a converter 25 for converting the digital signals SN into the $S_l$ channels.

In a variant, the converter 25 is non-existent, if the source 24 delivers the $S_i$ channels directly.

The processing electronics 10 is advantageously located in the frame 5 (although shown outside in FIG. 1 for clarity).

In a variant (not shown), the processing electronics 10 includes a player (not shown) for sound files recorded on compact discs, for example.

In still another variant, the processing electronics 10 comprises a memory containing sound files that can be read and converted by the converter 25 into analog signals.

The processing unit 20 comprises an optional frequency selector 26 adapted to extract signals from each channel $S_i$, and a splitter 28 configured to form the loudspeaker signals $SS_j$ from the extracted signals.

As visible in FIG. 2, the frequency selector 26 is designed to extract, from each channel $S_i$, a low-frequency signal $S_{i,LF}$, in which the audio frequencies of the channel Si above a predetermined first frequency f1 are reduced, and at least one other signal $S_{i,MF}$, in which the audio frequencies of the channel $S_i$ below the first frequency f1 are reduced. If the channel Si is not meant to comprise audio frequencies that are higher than the first frequency f1, the other signal $S_{i,MF}$ is not extracted, as will be seen later.

The first frequency f1 is, for example, greater than or equal to 200 Hz and less than or equal to 500 Hz.

Advantageously, the frequency selector 26 is also designed for extracting a high-frequency signal $S_{i,HF}$ in which the audio frequencies of the channel Si below a second frequency f2 are reduced, the second frequency f2 being higher than the first frequency f1. The frequency selector 26 is adapted so that, in each of the other signals $S_{i,MF}$, the audio frequencies that are higher than the second frequency f2 are also reduced.

The second frequency f2 is, for example, greater than or equal to 1000 Hz, preferably 3000 Hz, and less than or equal to 10000 Hz, preferably 4000 Hz.

For example, for each channel $S_i$, the frequency selector 26 comprises a low-pass filter $\mathbf{30}_i$ with a cutoff frequency f1 to extract the low-frequency signals $S_{i,LF}$, a band-pass filter $\mathbf{32}_i$ with cutoff frequencies f1 and f2 to extract the other signals $S_{i,MF}$ and finally a high-pass filter 34*i* with a cutoff frequency f2 to obtain the high-frequency signal $S_{i,HF}$.

According to a variant not shown, the high frequency signals $S_{i,HF}$ are not extracted. In this case, the frequency selector 26 includes a high-pass filter instead of the band-pass filter $\mathbf{32}_i$, the high-pass filter having a cut-off frequency f1. Also, in this case, the high-pass filter 34, is non-existent or not used.

In the low-frequency signals $S_{i,LF}$, the audio frequencies that are higher than the frequency f1 are reduced the more the low-pass filter $\mathbf{30}_i$ is effective.

Similarly, in other $S_{i,MF}$ signals, audio frequencies below f1 and above f2 are reduced the more effective the bandpass filter $\mathbf{32}_i$ is, and in high-frequency $S_{i,HF}$ signals, audio frequencies below frequency f2 are reduced the more effective the high-pass filter $\mathbf{34}_i$ is.

With reference to FIG. 3, the splitter 28 includes a first summing device 36 designed for summing up the low-frequency signals $S_{1,LF}$ to $S_{N,LF}$ and obtain a shared bass component $SS_{LF}$, and a multiplier 38 to multiply a shared bass component $SS_{LF}$ by a coefficient $G_{LF}$.

The splitter 28 also comprises, for each loudspeaker $HP_j$, N multipliers $\mathbf{40}_{1,j}$ to $\mathbf{40}_{N,j}$ for multiplying the other signals $S_{1,MF}$ to $S_{N,MF}$ respectively by coefficients $G_{1,j,MF}$ to $G_{N,j,MF}$, and a second summing device $\mathbf{42}_j$ for summing up the obtained multiplied signals and obtaining a specific component $SS_{j,MF}$.

Advantageously, the splitter 28 comprises a third summing device 44 for summing up the possible high frequency signals $S_{1,HF}$ to $S_{N,HF}$, and a multiplier 46 for multiplying the sum by a coefficient $G_{HF}$ and obtaining a shared high frequency component $SS_{HF}$.

Finally, the splitter 28 includes, for each loudspeaker $HP_j$, a fourth summing device 48*j* for summing up the shared bass component $SS_{LF}$, the specific component $SS_{j,MF}$ and the shared high-frequency component $SS_{HF}$ and obtain the loudspeaker signal $SS_j$.

The operation of the acoustic system 1 is easily deduced from its structure, so it will be described briefly below, and then particular embodiments with reference to FIGS. 4 through 8.

The source 24 is connected to the connector 22 to which it sends the digital signals SN received by the converter 25. The latter converts the digital signals SN into the N channels $S_i$.

As can be seen in FIG. 2, for each of the channels $S_i$, the low-pass filter $\mathbf{30}_i$ filters out the audio frequencies that are higher than the frequency f1 and the low-frequency signal Si,LF is obtained. Similarly, the band pass filter $\mathbf{32}_i$ filters the audio frequencies lower than the frequency f1 and those higher than the frequency f2 and the other signal $S_{i,MF}$ is obtained. Finally, the high-pass filter $\mathbf{34}_i$ filters the audio frequencies below the frequency f2 and the high-frequency signal $S_{i,HF}$ is obtained.

The low-frequency signals $S_{i,LF}$, the other signals $S_{i,MF}$ and the high-frequency signals $S_{i,HF}$ are sent to the splitter 28, which makes linear combinations of them to form the loudspeaker signals $SS_j$.

The shared bass component $SS_{LF}$, as its name implies, is common to all the loudspeakers and has a value of $G_{LF}*(S_{1,LF}+\ldots+S_{N,LF})$.

The shared high frequency component $SS_{HF}$, as its name implies, is common shared to all loudspeakers $HP_j$ and has a value of $G_{HF}*(S_{1,HF}+\ldots+S_{N,HF})$.

The specific component $SS_{j,MF}$ is particular to each loudspeaker and has a value of $G_{1,j,MF}*S_{1,MF}+\ldots+G_{N,j,MF}*S_{N,MF}$.

At least two of the specific components $SS_{j,MF}$ are different from each other. This enables in particular a lateralization effect.

For each of the loudspeakers $HP_j$, the summing device $\mathbf{48}_j$ sums up the shared bass component $SS_{LF}$, the shared high frequency component $SS_{HF}$, and the specific component $SS_{j,MF}$ to obtain the loudspeaker signal $SS_j$.

Each respective loudspeaker signal $SS_j$ is sent to the corresponding loudspeaker $HP_j$ to be transformed into sound waves.

The coefficients $G_{1,j,MF}$ to $G_{N,j,MF}$ define, for each loudspeaker, the linear combination realized for the medium frequencies. The respective values of the coefficients $G_{1,j,MF}$ to $G_{N,j,MF}$ determine main diffusion zones of each channel, as will be seen in several examples below.

In a variant, the processing unit 20 does not include the frequency selector 26. This variant is suitable for cases where the $S_i$ channels directly provide a signal proportional to the shared bass component $SS_{LF}$, and signals proportional to the other $S_{i,MF}$ signals and any high frequency $S_{i,HF}$ signals.

Thanks to the characteristics described above, the specific components $SS_{j,MF}$ being particular to at least two or even each loudspeaker $HP_j$, there is created for a listener 50, not only a lateralization of the perceived sound, but also an effect of depth, as it will appear in the examples below.

The frame 5 is very compact and simple to build. Thus, the acoustic system 1 gives an impression of depth of sound to the listener, while remaining simple and easy to implement.

In particular, as the loudspeakers $HP_j$ receive the same shared bass component $SS_{LF}$ and are regularly arranged at an angle around the Z axis, the mechanical vibrations related to the diffusion of the bass sound waves (of frequencies lower than f1) by each of the loudspeakers have a mechanical result that is substantially zero, which prevents the frame 5 from moving due to vibrations on a support such as a table or a shelf.

As the specific component $SS_{j,MF}$ is located in a range of average sound frequencies that are higher than the frequency f1, the differentiation between loudspeakers for these frequencies does not create any consequent mechanical vibrations that could lead to a displacement of the frame 5 with respect to a support The fact that the shared high frequency component $SS_{HF}$ is common to all HPj loudspeakers does not affect the depth effect, since the relatively high frequency sound waves (with a frequency higher than f2) are not likely to create a depth or lateralization effect.

Thanks to a differentiated treatment relating only to the intermediate sound waves in the example (between the frequencies f1 and f2), a depth effect is obtained in a simple way and by limiting the mechanical vibrations by an undifferentiated treatment of the low frequencies (lower than frequency f1).

Two Loudspeaker and Two Channel Embodiment

With reference to FIGS. 1 and 4, an acoustic system 100 according to a first concrete embodiment of the invention is described. The acoustic system 100 is similar to the acoustic system 1 shown in FIGS. 1 to 3, the similar elements have the same numerical references and will not be described again. Only the differences and specifics will be described in detail below.

In the acoustic system 100, the source 24 is a stereo source. The channels Si have a left channel L and a right channel R.

The number M of loudspeakers is equal to two, with the loudspeakers $HP_j$ including a first loudspeaker $HP_1$ receiving a first loudspeaker signal $SS_1$, and a second loudspeaker $HP_2$ receiving a second loudspeaker signal $SS_2$. The loudspeakers $HP_1$ and $HP_2$ are mounted at 180° to each other about the Z axis.

The listener 50 is optimally located at 90° to the axes D1, D2.

The splitter 28 is configured so that:

$$SS_1=a*[1*L_{MF}+SS_{LF}+SS_{HF}] \text{ and}$$

$$SS_2=a*[1*R_{MF}+SS_{LF}+SS_{HF}],$$

$$\text{with } SS_{LF}=\tfrac{1}{2}*(L_{LF}+R_{LF}) \text{ and } SS_{HF}=\tfrac{1}{2}*(L_{HF}+R_{HF}),$$

$L_{LF}$ being the low frequency signal of the left channel L, $L_{MF}$ being the other signal of the left channel L, $L_{HF}$ being the high frequency signal of the left channel L, $R_{LF}$ being the low frequency signal of the right channel R, $R_{MF}$ being the other signal of the right channel R, $R_{HF}$ being the high frequency signal of the right channel R, a being a proportionality coefficient.

Thus, the loudspeaker $HP_1$ diffuses the medium frequency sound waves LMF mainly in an area 102 centered in the direction D1. The loudspeaker $HP_2$ diffuses the medium frequency sound waves $R_{MF}$ mainly in an area 104 centered in the direction D2.

The arrangement of the loudspeakers at 180° and their differentiation in the frequencies of the MF range enables a depth of sound effect with only two loudspeakers. The depth is symbolized in FIGS. 4 to 8 by a double arrow P.

Three Loudspeaker and Two Channels Embodiment

With reference to FIGS. 1 and 5, an acoustic system 110 according to a second embodiment of the invention is described. The acoustic system 110 is similar to the acoustic system 1 shown in FIGS. 1 to 3. Only the differences and specifics will be described in detail below.

In the acoustic system 110, the source 24 is also a stereo source, with the channels Si comprising a left channel L and a right channel R.

The number M of loudspeakers $HP_j$ is equal to three, the loudspeakers $HP_j$ comprising a first loudspeaker $HP_1$ receiving a first loudspeaker signal $SS_1$, a second loudspeaker HP2 receiving a second loudspeaker signal $SS_2$, and a third loudspeaker $HP_3$ receiving a third loudspeaker signal $SS_3$. The loudspeakers $HP_1$, $HP_2$, and $HP_3$ are successively mounted at 120° to each other about the Z axis.

The listener 50 is optimally located in the extension of the D1 axis from the frame 5.

The splitter 28 is configured so that:

$$SS_1=a*[\tfrac{1}{2}*(L_{MF}+R_{MF})+SS_{LF}+SS_{HF}],$$

$$SS_2=a*[\tfrac{1}{2}*L_{MF}+SS_{LF}+SS_{HF}], \text{ and}$$

$$SS_3=a*[\tfrac{1}{2}*R_{MF}+SS_{LF}+SS_{HF}],$$

$$\text{with } SS_{LF}=\tfrac{1}{3}*(L_{LF}+R_{LF}) \text{ and } SS_{HF}=\tfrac{1}{3}*(L_{HF}+R_{HF}),$$

$L_{LF}$ being the low frequency signal of the left channel L, $L_{MF}$ being the other signal of the left channel L, $L_{HF}$ being the high frequency signal of the left channel L, $R_{LF}$ being the low frequency signal of the right channel R, $R_{MF}$ being the other signal of the right channel R, $R_{HF}$ being the high frequency signal of the right channel R, a being a proportionality coefficient.

Thus, the loudspeakers $HP_1$ and $HP_2$ diffuse the medium frequency sound waves $L_{MF}$ mainly in an area 112 extending at an angle between the axes D1 and D2 and a little beyond. The loudspeakers $HP_1$ and $HP_3$ diffuse the medium frequency sound waves $R_{MF}$ mainly in an area 114 extending at an angle between the axes D1 and D3 and a little beyond.

The arrangement of the loudspeakers at 120° and their differentiation in the frequencies of the MF range enables a depth of sound effect with only three loudspeakers and two channels.

Three Loudspeaker and Six Channels Embodiment

With reference to FIGS. 1 and 6, an acoustic system 120 according to a third embodiment of the invention is described. The acoustic system 120 is similar to the acoustic system 1 shown in FIGS. 1 to 3. Only the differences and specifics will be described in detail below.

In the acoustic system 120, the source 24 is, for example, a Dolby 5.1 source having five channels $S_1$ to $S_5$ and a channel $S_6$ having no audio frequencies that are higher than the first frequency f1.

For example, $S_1$ is a left channel, $S_2$ is a right channel, $S_3$ is a center channel, $S_4$ is a side surround et left rear, $S_5$ is a side surround et right rear, and $S_6$ is a low frequency effects channel.

The number M of loudspeakers $HP_j$ is equal to three and the loudspeakers and the listener 50 are arranged as for the acoustic system 110.

The splitter 28 is configured so that:

$$SS_1=a*[\tfrac{1}{3}*S_{1,MF}+\tfrac{1}{3}*S_{2,MF}+1*S_{3,MF}+SS_{LF}+SS_{HF}],$$

$$SS_2=a*[\tfrac{2}{3}*S_{1,MF}+1*S_{4,MF}+SS_{LF}+SS_{HF}], \text{ and}$$

$$SS_3=a*[\tfrac{2}{3}*S_{2,MF}+1*S_{5,MF}+SS_{LF}+SS_{HF}],$$

$$\text{with } SS_{LF}=\tfrac{1}{3}*(S_{1,LF}+S_{2,LF}+S_{3,LF}+S_{4,LF}+S_{5,LF}+S_{5,LF}+S_{6,LF}),$$

$$\text{and } SS_{HF}=\tfrac{1}{3}*(S_{1,HF}+S_{2,HF}+S_{3,HF}+S_{4,HF}+S_{5,HF}+S_{5,LF}),$$

$S_{1,LF}$ to $S_{6,LF}$ being the low frequency signals of channels $S_1$ to $S_6$, with $S_{6,LF}=S_6$, $S_{1,MF}$ to $S_{6,MF}$ being the other signals of channels $S_1$ to $S_6$, $S_{1,HF}$ to $S_{6,HF}$ being the high frequency signals of channels $S_1$ to $S_6$, a being a proportionality coefficient.

Thus, for the MF frequency range, the left channel $S_1$ is diffused mainly in an L-axis area 122, the right channel $S_2$ in an R-axis area 124, and the center channel $S_3$ in a D1-axis area 126. The side surround and left rear $S_4$ and the side surround and right rear $S_5$ are diffuse primarily in the respective areas 128, 130 of the SL and SR axes. The low frequency effects channel is not related to the differentiation.

The arrangement of the loudspeakers at 120° and their differentiation in the MF range frequencies enables a depth of sound effect with only three loudspeakers.

The invention claimed is:

1. An acoustic system designed for diffusing sound from N channels comprising audio frequencies, N being greater than or equal to two, the acoustic system comprising:

a frame,

M loudspeakers structurally similar to each other and mounted on the frame, M being greater than or equal to two, and a processing unit designed for sending M loudspeaker signals to the respective loudspeakers, wherein:

the loudspeakers are arranged at an angle about an axis intended to be substantially vertical, two successive loudspeakers forming an angle substantially equal to 360° divided by M, and the processing unit comprises a splitter configured to produce the loudspeaker signals, each loudspeaker signal comprising a same shared bass component obtained from at least one of the channels, and in which the audio frequencies that are higher than a predetermined first frequency are non-existent or reduced, at least two of the loudspeaker signals further comprising a specific component in addition to the shared bass component and in which the audio frequencies below the first frequency are non-existent or reduced, each specific component being obtained from at least one of the channels, and at least two of the specific components being different from each other, wherein the acoustic system further comprises a frequency selector adapted to produce, from each channel, on the one hand a low frequency signal in which the audio frequencies of the channel higher than the first frequency are non-existent or reduced, and on the other hand, if said channel comprises audio frequencies that are higher than the first frequency, at least one other signal in which the audio frequencies of the channel lower than the first frequency are non-existent or reduced, the shared bass component being proportional to the sum of the low frequency signals, the specific components being obtained from the other signals, and wherein the frequency selector is further configured to extract, from each respective channel comprising audio frequencies that are higher than a predetermined second frequency, a high-frequency signal in which the audio frequencies of said channel lower than the second frequency are non-existent or reduced, the second frequency being higher than the first frequency, the frequency selector being configured so that, in each of the other signals, the audio frequencies that are higher than the second frequency are non-existent or reduced; and at least one of the loudspeaker signals formed by the splitter further comprises a shared high frequency component proportional to the sum of the high frequency signals, the shared high frequency component being added to the shared bass component.

2. The acoustic system according to claim 1, wherein the first frequency is greater than or equal to 200 Hz and less than or equal to 500 Hz.

3. The acoustic system according to claim 1, wherein the specific components are linear combinations of at least some of the other signals.

4. The acoustic system according to claim 1, wherein the second frequency is greater than or equal to 1000 Hz and less than or equal to 10000 Hz.

5. The acoustic system according to claim 1, wherein:

the acoustic system is designed for diffusing the sound from a stereo source, the channels comprising a left channel L and a right channel R;

the number M of loudspeakers is equal to two, the loudspeakers comprising a first loudspeaker $HP_1$ receiving a first loudspeaker signal $SS_1$; and a second loudspeaker $HP_2$ receiving a second loudspeaker signal $SS_2$; and the splitter is configured so that:

$$SS_1=a*[1*L_{MF}+SS_{LF}+SS_{HF}] \text{ and}$$

$$SS_2=a*[1*R_{MF}+SS_{LF}+SS_{HF}],$$

$$\text{with } SS_{LF}=\tfrac{1}{2}*(L_{LF}+R_{LF}) \text{ and } SS_{HF}=\tfrac{1}{2}*(L_{HF}+R_{HF}),$$

$L_{LF}$ being the low frequency signal of the left channel L, $L_{MF}$ being the other signal of the left channel L, $L_{HF}$ being the high frequency signal of the left channel L, $R_{LF}$ being the low frequency signal of the right channel R, $R_{MF}$ being the other signal of the right channel R, $R_{HF}$ being the high frequency signal of the right channel R, a being a proportionality coefficient.

6. The acoustic system according to claim 1, wherein:

the acoustic system is designed for diffusing the sound from a stereo source, the channels comprising a left channel L and a right channel R;

the number M of loudspeakers is equal to three, the loudspeakers comprising a first loudspeaker $HP_1$ receiving a first loudspeaker signal $SS_1$, a second loudspeaker $HP_2$ receiving a second loudspeaker signal $SS_2$, and a third loudspeaker $HP_3$ receiving a third loudspeaker signal $SS_3$; and the splitter is configured so that:

$$SS_1=a*[\tfrac{1}{2}*(L_{MF}+R_{MF})+SS_{LF}+SS_{HF}],$$

$$SS_2=a*[\tfrac{1}{2}*L_{MF}+SS_{LF}+SS_{HF}], \text{ and}$$

$$SS_3=a*[\tfrac{1}{2}*R_{MF}+SS_{LF}+SS_{HF}],$$

$$\text{with } SS_{LF}=\tfrac{1}{3}*(L_{LF}+R_{LF}) \text{ and } SS_{HF}=\tfrac{1}{3}*(L_{HF}+R_{HF}),$$

$L_{LF}$ being the low frequency signal of the left channel L, $L_{MF}$ being the other signal of the left channel L, $L_{HF}$ being the high frequency signal of the left channel L, $R_{LF}$ being the low frequency signal of the right channel R, $R_{MF}$ being the other signal of the right channel R, $R_{HF}$ being the high frequency signal of the right channel R, a being a proportionality coefficient.

7. The acoustic system according to claim 1, wherein:

the acoustic system is designed for diffusing the sound from a source with five channels $S_1$ to $S_5$ and one channel $S_6$ with no audio frequencies that are higher than the first frequency;

the number M of loudspeakers is three, the loudspeakers including a first loudspeaker HP1 receiving a first loudspeaker signal $SS_1$, a second loudspeaker $HP_2$ receiving a second loudspeaker signal $SS_2$, and a third loudspeaker HP3 receiving a third loudspeaker signal $SS_3$; and the splitter is configured so that:

$$SS_1=a*[\tfrac{1}{3}*S_{1,MF}+\tfrac{1}{3}*S_{2,MF}+1*S_{3,MF}+SS_{LF}+SS_{HF}],$$

$$SS_2=a*[\tfrac{2}{3}*S_{1,MF}+1*S_{4,MF}+SS_{LF}+SS_{HF}], \text{ and}$$

$$SS_3=a*[\tfrac{2}{3}*S_{2,MF}+1*S_{5,MF}+SS_{LF}+SS_{HF}],$$

$$\text{with } SS_{LF}=\tfrac{1}{3}*(S_{1,LF}+S_{2,LF}+S_{3,LF}+S_{4,LF}+S_{5,LF}+S_{5,LF}+S_{6,LF}),$$

$$\text{and } SS_{HF}=\tfrac{1}{3}*(S_{1,HF}+S_{2,HF}+S_{3,HF}+S_{4,HF}+S_{5,HF}+S_{5,LF}),$$

$S_{1,LF}$ to $S_{6,LF}$ being the low frequency signals of channels $S_1$ to $S_6$, with $S_{6,LF}=S_6$, $S_{1,MF}$ to $S_{6,MF}$ being the other signals of channels $S_1$ to $S_6$, $S_{1,HF}$ tO $S_{6,HF}$ being the high frequency signals of channels $S_1$ to $S_6$, a being a proportionality coefficient.

8. The acoustic system according to claim 1, wherein:

the acoustic system is designed for diffusing the sound from a stereo source, the channels comprising a left channel L and a right channel R;

the number M of loudspeakers is equal to four, the loudspeakers comprising a first loudspeaker $HP_1$ receiving a first loudspeaker signal $SS_1$, a second loudspeaker $HP_2$ receiving a second loudspeaker signal $SS_2$, a third loudspeaker $HP_3$ receiving a third loudspeaker signal $SS_3$, and a fourth loudspeaker $HP_4$ receiving a fourth loudspeaker signal $SS_4$; and the splitter is configured so that:

$$SS_1=a*[½*L_{MF}+SS_{LF}+SS_{HF}],$$

$$SS_2=a*[½*R_{MF}+SS_{LF}+SS_{HF}],$$

$$SS_3=a*[½*L_{MF}+SS_{LF}+SS_{HF}], \text{ and}$$

$$SS_4=a*[½*R_{MF}+SS_{LF}+SS_{HF}],$$

$$\text{with } SS_{LF}=¼*(L_{LF}+R_{LF}) \text{ and } SS_{HF}=¼*(L_{HF}+R_{HF}),$$

$L_{LF}$ being the low frequency signal of the left channel L, $L_{MF}$ being the other signal of the left channel L, $L_{HF}$ being the high frequency signal of the left channel L, $R_{LF}$ being the low frequency signal of the right channel R, $R_{MF}$ being the other signal of the right channel R, $R_{HF}$ being the high frequency signal of the right channel R, a being a proportionality coefficient.

9. The acoustic system according to claim 1, wherein:

the acoustic system is designed for diffusing the sound from a source with five channels $S_1$ to $S_5$ and one channel $S_6$ with no audio frequencies that are higher than the first frequency;

the number M of loudspeakers is equal to four, the loudspeakers including a first loudspeaker $HP_1$ receiving a first loudspeaker signal $SS_1$, a second loudspeaker $HP_2$ receiving a second loudspeaker signal $SS_2$, a third loudspeaker $HP_3$ receiving a third loudspeaker signal $SS_3$, and a fourth loudspeaker $HP_4$ receiving a fourth loudspeaker signal $SS_4$; and the splitter is adapted such that:

$$SS_1=a*[1*S_{3,MF}+¼*S_{1,MF}+¼*S_{2,MF}+SS_{LF}+SS_{HF}],$$

$$SS_2=a*[¾*S_{1,MF}+½*S_{4,MF}+SS_{LF}+SS_{HF}],$$

$$SS_3=a*[½*S_{4,MF}+½*S_{5,MF}+SS_{LF}+SS_{HF}], \text{ and}$$

$$SS_4=a*[¾*S_{2,MF}+½*S_{5,MF}+SS_{LF}+SS_{HF}],$$

$$\text{with } SS_{LF}=¼*(S_{1,LF}+S_{2,LF}+S_{3,LF}+S_{4,LF}+S_{5,LF}+S_{6,LF}),$$

$$\text{and } SS_{HF}=¼*(S_{1,HF}+S_{2,HF}+S_{3,HF}+S_{4,HF}+S_{5,HF}+S_{5,LF}),$$

$S_{1,LF}$ to $S_{6,LF}$ being the low frequency signals of channels $S_1$ to $S_6$, with $S_{6,LF}=S_6$, $S_{1,MF}$ to $S_{6,MF}$ being the other signals of channels $S_1$ to $S_6$, $S_{1,HF}$ to $S_{6,HF}$ being the high frequency signals of channels $S_1$ to $S_6$, a being a proportionality coefficient.

10. A method for diffusing sound from N channels comprising audio frequencies, N being greater than or equal to two, the method comprising:

providing M loudspeakers structurally similar to each other and mounted on a same frame, M being greater than or equal to two, the loudspeakers being arranged at an angle around an axis intended to be substantially vertical, two successive loudspeakers forming an angle substantially equal to 360° divided by M, sending, by a processing unit, M loudspeaker signals respectively to the loudspeakers, and generating the loudspeaker signals by a splitter of the processing unit, each loudspeaker signal produced having a shared bass component obtained from at least one of the channels, and in which audio frequencies that are higher than a predetermined first frequency are non-existent or reduced, at least two of the loudspeaker signals further comprising a specific component in addition to the shared bass component and in which audio frequencies below the first frequency are non-existent or reduced, each specific component being obtained from at least one of the channels, and at least two of the specific components being different from each other selecting frequencies in order to produce, from each channel, on the one hand a low frequency signal in which the audio frequencies of the channel higher than the first frequency are non-existent or reduced, and on the other hand, if said channel comprises audio frequencies that are higher than the first frequency, at least one other signal in which the audio frequencies of the channel lower than the first frequency are non-existent or reduced, the shared bass component being proportional to the sum of the low frequency signals, the specific components being obtained from the other signals, extracting, from each respective channel comprising audio frequencies that are higher than a predetermined second frequency, a high-frequency signal in which the audio frequencies of said channel lower than the second frequency are non-existent or reduced, the second frequency being higher than the first frequency, the frequency selector being configured so that, in each of the other signals, the audio frequencies that are higher than the second frequency are non-existent or reduced; and at least one of the loudspeaker signals formed by the splitter further comprises a shared high frequency component proportional to the sum of the high frequency signals, the shared high frequency component being added to the shared bass component.

11. The acoustic system according to claim 1, wherein all the loudspeaker signals formed by the splitter further comprise a shared high frequency component proportional to the sum of the high frequency signals, the shared high frequency component being added to the shared bass component.

* * * * *